US008752876B2

(12) United States Patent
Niekamp et al.

(10) Patent No.: US 8,752,876 B2
(45) Date of Patent: Jun. 17, 2014

(54) POST DRIVER WITH GRAPPLER MECHANISM

(71) Applicant: Danuser LLC, Fulton, MO (US)

(72) Inventors: Gary J Niekamp, Jefferson City, MO (US); Tyler Van Lant, Columbia, MO (US)

(73) Assignee: Danuser LLC, Fulton, MO (US)

( * ) Notice: Subject to any disclaimer, the term of this patent is extended or adjusted under 35 U.S.C. 154(b) by 0 days.

(21) Appl. No.: 13/753,253

(22) Filed: Jan. 29, 2013

(65) Prior Publication Data

US 2013/0140836 A1 Jun. 6, 2013

(51) Int. Cl.
*E04H 17/26* (2006.01)
*B66C 1/00* (2006.01)

(52) U.S. Cl.
USPC ..... 294/198; 294/106

(58) Field of Classification Search
USPC ..... 294/198, 104, 106, 85, 86.4, 86.41, 294/902; 269/257; 414/729, 739, 740; 175/19
See application file for complete search history.

(56) References Cited

U.S. PATENT DOCUMENTS 4,709,968 A * 12/1987 Tanaka et al. ..... 303/9.75
4,890,680 A * 1/1990 Porsfeld ..... 173/42
5,026,104 A * 6/1991 Pickrell ..... 294/86.4
5,332,047 A * 7/1994 Hignite ..... 173/1
6,105,683 A 8/2000 Thiessen
6,702,037 B1 3/2004 Thiessen
8,267,193 B1 * 9/2012 Hurley ..... 173/185
8,414,043 B2 * 4/2013 Albin et al. ..... 294/106
2012/0121323 A1 * 5/2012 Hill ..... 403/321
2013/0140053 A1 * 6/2013 Niekamp et al. ..... 173/93

OTHER PUBLICATIONS

Danuser Hammer advertisement from Compact Equipment magazine, published Apr. 2012, p. 25.
Images of Anti-Dry Fire Mechanism, Jul. 24, 2012.
Danuser Postmaster brochure, at least as early as Aug. 8, 2007.
Danuser Hammer SM40, Operator's Manual, Jul. 10, 2012.
Danuser Hammer brochure, at least as early as Feb. 7, 2012.
Quick Attach Attachments, Inc. Quick Sledge brochure, at least as early as 2011.
Bradco PD4800 Post Driver, Operator's and Parts Manual, published Aug. 16, 2005, pp. 4-6.
Bradco PD4800 Post Driver, Operator's and Parts Manual, published Aug. 20, 2005, p. 3.
Bradco PD4800 Post Driver, Operator's and Parts Manual, published Sep. 28, 2005, p. 25.

(Continued)

*Primary Examiner* — Paul T Chin
(74) *Attorney, Agent, or Firm* — Husch Blackwell LLP

(57) ABSTRACT

A grapple mechanism is connected to a post driver on one side, rather than in the front of the post driver. The grapple connects to the post driver via a hinge which allows substantially 90 degrees of rotation between a horizontal position for picking up posts, and a vertical position for driving the post into the ground. A spring or other biasing mechanism preferably biases the grapple mechanism toward its horizontal position. However, the spring is preferably not so strong as to hold the grapple mechanism in the horizontal position even when a post is grappled. Preferably, the weight of a grappled post is sufficient to overcome the spring, causing the grapple mechanism to pivot about the hinge and into the vertical position. The grapple mechanism is therefore preferably sized, shaped and weighted so as to swing to a substantially vertical position when a post is grappled and lifted.

15 Claims, 3 Drawing Sheets

(56) References Cited

OTHER PUBLICATIONS

Bradco PD4800 Post Driver, Operator's and Parts Manual, published Mar. 20, 2008, p. 23.
Bradco PD4800 Post Driver, Operator's and Parts Manual, published Jul. 9, 2008, pp. 26-29.
Bradco PD4800 Post Driver, Operator's and Parts Manual, published Jul. 10, 2008, pp. 7, 8, 10-13, and 16.
Bradco PD4800 Post Driver, Operator's and Parts Manual, published Jul. 14, 2008, p. 14.
Bradco PD4800 Post Driver, Operator's and Parts Manual, published Jul. 21, 2008, pp. 17-20.
Bradco PD4800 Post Driver, Operator's and Parts Manual, published Jul. 22, 2008, p. 40.
Bradco PD4800 Post Driver, Operator's and Parts Manual, published Jul. 23, 2008, pp. 9, 30-39, and 41.
Bradco PD4800 Post Driver, Operator's and Parts Manual, published Jul. 24, 2008, pp. 1, 15, 21, 22, 24, 42-43.
Bradco PD4800 Post Driver, Operator's and Parts Manual, published Aug. 8, 2008, cover page.

* cited by examiner

POST DRIVER WITH GRAPPLER MECHANISM

CROSS-REFERENCE TO RELATED APPLICATIONS

No related application.

BACKGROUND OF THE DISCLOSURE

1. Field of Disclosure

This disclosure relates generally to a post driver with grapple mechanism, and more particularly, to a grapple member on a post driver which is biased toward a generally horizontal position at rest, but which rotates into a generally vertical position suitable for post-driving when a post is grappled.

2. Background Art

Post drivers that utilize the pile driving principle of raising a weight to some distance above a post and then dropping the weight in order to drive the post rely heavily upon the skill of the operators to properly position the post and post driver in the correct position. Indeed, many post drivers require at least two operators—one to position the post and another to operate the skid-steer and the post driver itself. When a post is properly positioned within the post driver, the kinetic energy of the falling might is transferred into the post, pushing it into the ground. However, when a post is not properly positioned within the post driver, various issues may arise. The weight may fail to contact the post upon falling, and may instead impact upon the frame of the post driver (a dry fire), or the post may be extend too far into the post driver such that the overall driving performance of the driver is reduced due to a shorter stroke length. Additionally, the use of two operators creates inefficiencies and slowdowns, and puts the operator in charge of positioning the post in a position of some danger.

Hydraulic grapple mechanisms have been added to some existing devices to reduce the number of operators necessary to drive posts. Generally, such mechanisms include hydraulics for actuation of the grapple, as well as for swinging the grapple mechanism into and/or out of proper alignment with the post driver. Additionally, most such grapple mechanisms are located on the front of the housing of the post driver, creating two problems. First, when swinging from a horizontal to a vertical position, the post is angled directly at the operator in the skid-steer. If the post slips out of the grapple mechanism, it will fall toward the skid-steer and the operator. Second, this positioning puts the post driver in between the operator and the post, making it hard for the operator to see what is happening.

BRIEF SUMMARY OF DISCLOSURE

The post driver includes a grapple mechanism which is connected to the post driver on one side, rather than in the front of the post driver. The grapple connects to the post driver via a hinge which allows substantially 90 degrees of rotation between a horizontal position for picking up posts, and a vertical position for driving the post into the ground. A biasing mechanism such as a spring or counterweight preferably biases the grapple mechanism toward its horizontal position. However, the biasing mechanism is prefer ably not so strong as to hold the grapple mechanism in the horizontal position even when a post is grappled. Preferably, the weight of a grappled post is sufficient to overcome the biasing mechanism, causing the grapple mechanism to pivot about the hinge and into the vertical position. The grapple mechanism is therefore preferably sized, shaped and weighted so as to swing to a substantially vertical position when a post is grappled and lifted.

The jaws of the grapple are preferably actuated by hydraulics or other suitable mechanisms, and are preferably geared rotatable jaws to rotate open and closed rather than a sliding jaw. Sliding jaws tend to limit the range of post size and weight that can be effectively grappled, whereas geared rotatable jaws allow for a broader range of post sizes and weights while using fewer components.

Accordingly, an aspect of the present disclosure is a post driver comprising a main housing, a grapple mechanism rotatably attached to the housing, the grapple mechanism including geared rotatable jaws, and a biasing mechanism associated with the grapple mechanism, wherein the biasing mechanism allows for rotation of the grapple mechanism when the grapple mechanism is grappled with a post, but which mechanically prevents rotation of the grapple mechanism when the grapple mechanism is not grappled with a post.

In another embodiment, an aspect of the present disclosure is a grapple mechanism rotatably attached, to a post driver about a pivot point, the grapple mechanism comprising rotatable jaws, gears for rotating the jaws, a grapple housing supporting the jaws and gears, and a biasing mechanism structured to bias the grapple mechanism in a generally horizontal position when at rest, but having an insufficient bias to maintain the grapple mechanism in the generally horizontal position when the rotatable jaws grapple and lift a post.

In another embodiment, an aspect of the present disclosure is a post driver comprising a main housing, a grapple housing pivotally connected to a side of the main housing other than a front side, and hydraulically actuated geared rotatable jaws associated with the grapple housing, wherein pivoting of the grapple housing about a pivot point positions the geared rotatable jaws underneath the main housing from the side of the main housing.

BRIEF DESCRIPTIONS OF THE DRAWINGS

For a better understanding of the present disclosure, reference may be made to the accompanying drawings in which.

Figure 2:
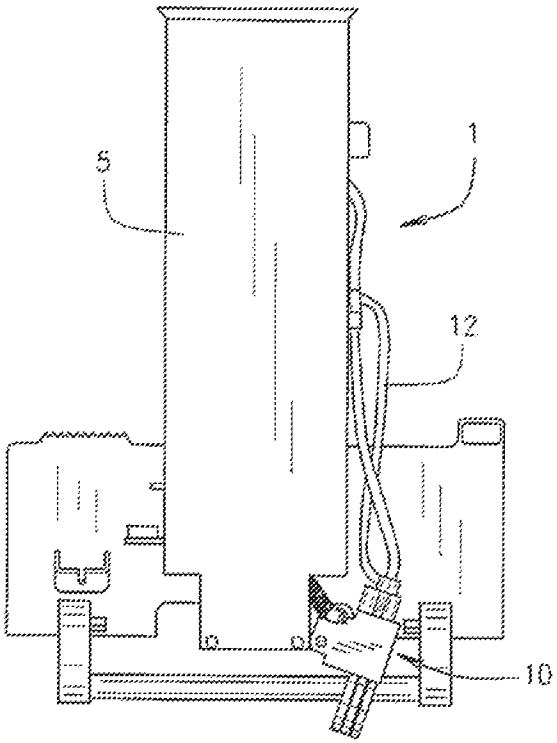
FIG. 2 is a front elevation illustration of a post driver with a grapple mechanism according to one embodiment of the present invention.

While the disclosure is susceptible to various modifications and alternative forms, specific embodiments thereof are shown by way of example in the drawing and will herein be described in detail. If should be understood, however, that the drawings and detailed description presented herein are not intended to limit the disclosure to the particular embodiment disclosed, but on the contrary, the intention is to cover all modifications, equivalents, and alternatives felling within the spirit and scope of the present disclosure as defined by the appended claims.

DETAILED DESCRIPTIONS OF THE DISCLOSURE

Figure 1:
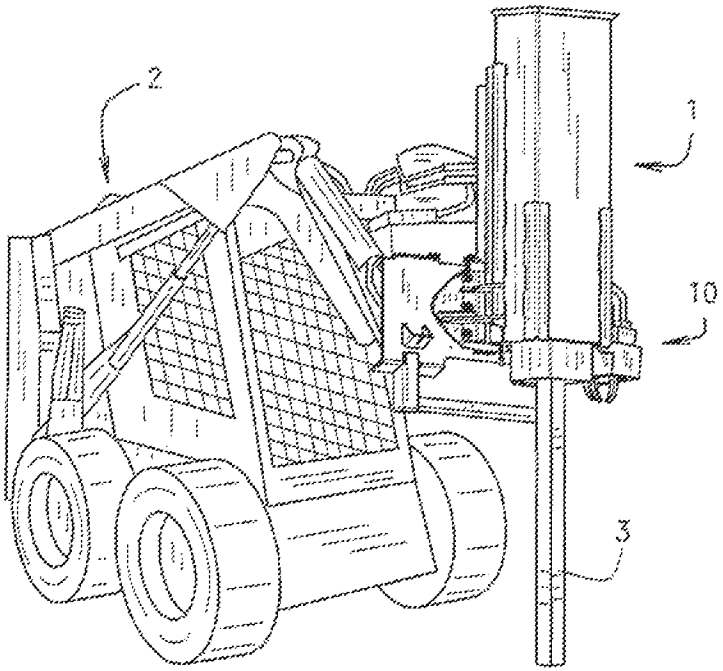
FIG. 1 is a perspective view of a post driver mounted in front of a mobile vehicle or equipment, such as a skid-steer.

Referring to FIG. 1, an embodiment of the present post driver 1 is shown as connected to a skid-steer loader 2, in position to drive a post 3 into the ground utilizing a grapple mechanism 10 according to one embodiment of the present invention. Post driver 1 may instead be adapted for attachment to and operation via a front-end loader or any other suitable vehicle. As shown in FIG. 2, post driver 1 includes an outer housing 5 which contains the internal workings of the post driver 1. Grapple mechanism 10 may be connected to the outer housing 5, or may be otherwise attached to the post driver 1.

Figure 3:
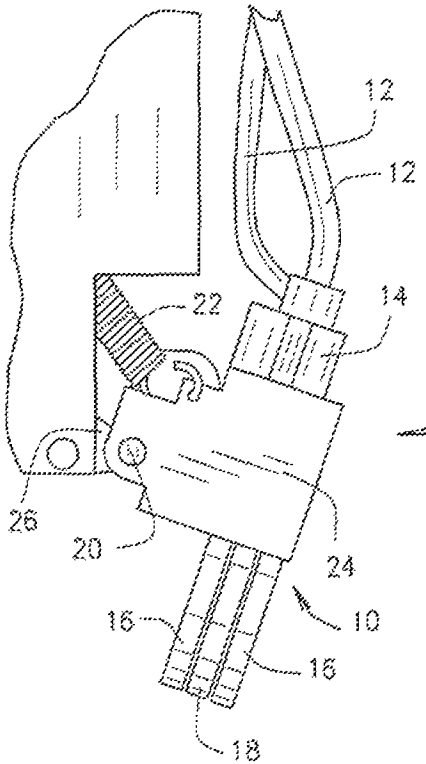
FIG. 3 is a front elevation close-up view of the grapple mechanism of FIG. 2.

As shown in FIG. 3, which is a close-op view of the grapple mechanism 10, the grapple mechanism may be controlled hydraulically by hydraulic lines 12. Although hydraulics are the preferable source of power for such a device, other options such as electrical power and motors, etc., are also contemplated. Grapple mechanism 10 preferably includes gears 14 designed to rotatably open and close jaws 16 and jaw 18 by hydraulic actuation. Gears 14 allow jaws 16, 18 to be rotatably opened and closed to accommodate a broader range of sizes of posts 3 more securely as compared to a sliding jaw mechanism. As shown, grapple mechanism 10 includes two jaws 16 spaced apart to allow single opposing jaw 18 to pass there between, when fully closed. Such a configuration allows for jaws 16, 18 to fully close around a smaller post 3, and to pinch larger posts 3 therebetween. However, this configuration is merely exemplary.

Gears 14 and jaws 16, 18 are secured to a grapple housing 24. The grapple mechanism 10 is preferably attached to the post driver 1 via the grapple housing 24. As shown in FIG. 3, grapple housing 24 connects to a flange 26 of the housing 5 via a pin 20. Pin 20 allows for approximately ninety degrees of rotation of the grapple mechanism 10 about the pin 20. Other structures which serve to attach the grapple mechanism 10 to the post driver 1 are also contemplated, such as a hinge or the like.

When the grapple mechanism 10 is at rest, the grapple housing 24 is preferably biased by a biasing mechanism, shown in FIG. 3 as spring 22, toward a position which is generally parallel with the ground. In this position, jaws 16, 18 preferably extend downwardly and are substantially perpendicular to the ground, so as to be in a proper position for grappling a post lying on the ground, when desired. Thus, the spring 22 is generally strong enough to hold the grapple mechanism 10 in this generally horizontal position, when the grapple jaws 16, 18 are open and are not holding a post 3. Thus, the position of the grapple mechanism 10 is preferably controlled mechanically, rather than by hydraulics in this embodiment. For the purposes hereof, "mechanically" is defined as utilizing no hydraulic, electrical or other external assistance other than the physical size, shape and material properties of the object. Other embodiments may utilize hydraulics to position the grapple mechanism 10, rather than spring 22 or another biasing structure.

In operation, the post driver 1 with the grapple mechanism 10 in its horizontal position is lowered to grapple a post 3. As shown in FIGS. 1-5, the grapple mechanism 10 is preferably positioned on one side of the post driver 1, rather than on the front of the post driver 1. As positioned on the side of the post driver 1, the sightlines of the operator of the skid-steer are not blocked by the post driver 1 itself. The operator therefore has a better view of the grapple mechanism 10 as it approaches the post 3 on the ground, and can thereby more easily position the grapple mechanism 10 over the post 3 to grapple the post 3.

Once the jaws 16, 18, are positioned around the post 3, the operator uses the hydraulics to close the jaws 16, 18 around the post 3. The hydraulics, via hydraulic lines 12, cause the gears 14 to rotate so as to rotate the jaws 16, 18 into a closed position which either pinches the post 3 or closes around the post, depending on the size of the post 3. Having secured the post 3 in the jaws 16, 18, the post driver 1 can be lifted back up toward its post driving position. As the post driver 1 is lifted, the grapple mechanism lifts the post 3. As the weight of the post 3 begins to be carried by the grapple mechanism 10, the biasing spring 22 is no longer capable of holding the grapple mechanism 10 in its horizontal resting position. The weight of the grapple mechanism 10 in combination with the weight of the post is sufficient to overcome the tension of the spring 22, and the grapple mechanism 10 pivots about pin 20.

Figure 5:
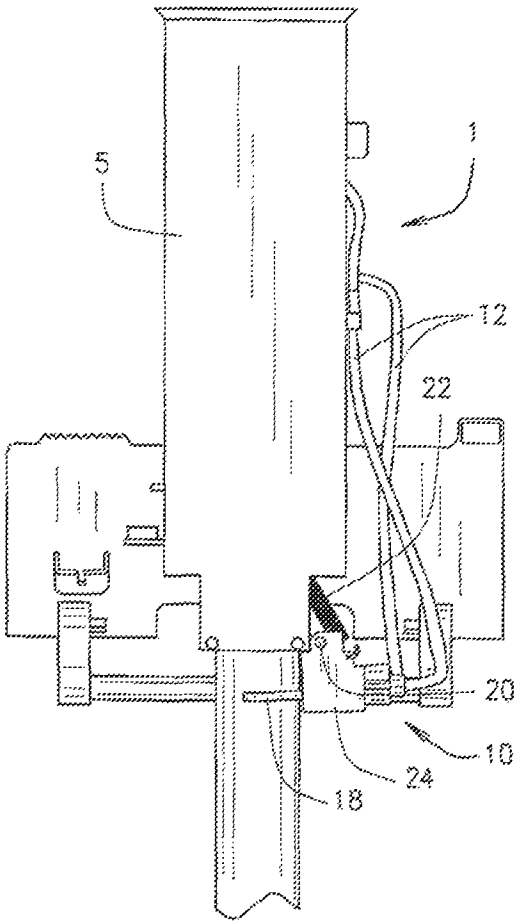
FIG. 5 is a front elevation view of a post driver with a grapple mechanism in its vertical position having grappled a post.
Figure 4:
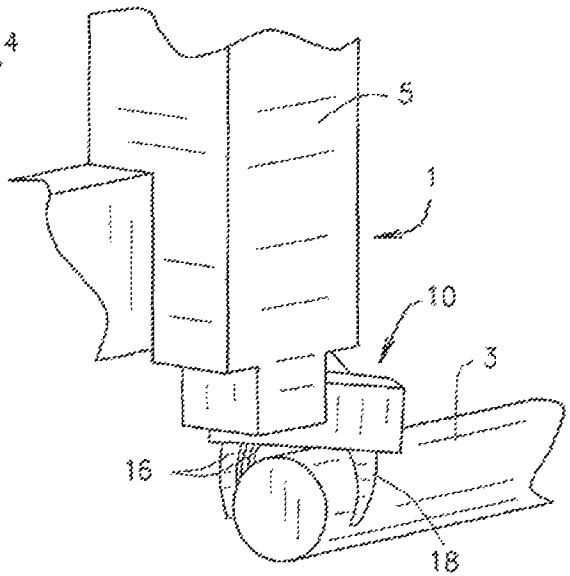
FIG. 4 is a perspective view of a post driver with a grapple mechanism in its horizontal position to grapple a post.

Thus, the weight of the post 3 causes the grapple mechanism 10 to swing into its vertical position, shown in FIG. 5. When the grapple mechanism 10 is in its vertical position, the jaws 16, 18 extend substantially parallel with the ground so as to hold the post 3 substantially vertically. As can be seen in FIG. 5, the grapple mechanism 10 is sized and shaped such that upon rotation of the grapple mechanism 10 about pin 20, the post 3 is held substantially in position for being driven into the ground by post driver 1. That is, post 3 is positioned directly underneath the post driver 1, and may even extend at least partially up into post driver 1. Grapple mechanism 10 preferably thereby positions the post 3 for being driven into the ground without the use of additional hydraulics to position the grapple mechanism 10. The weight of the post 3 also serves to keep the post 3 in position for driving, even if the post 3 needs to be transported around the job site.

Additionally, by positioning the grapple mechanism 10 to one side of the post driver 1 rather than at its front, when the post 3 swings from its resting horizontal position into a vertical position for driving, the post 3 is never angled at the operator of the skid-steer. If the post 3 were to slip from the jaws 16, 18, the post 3 would merely fall to one side of the post driver 1, rather than back toward the operator.

Figure 7:
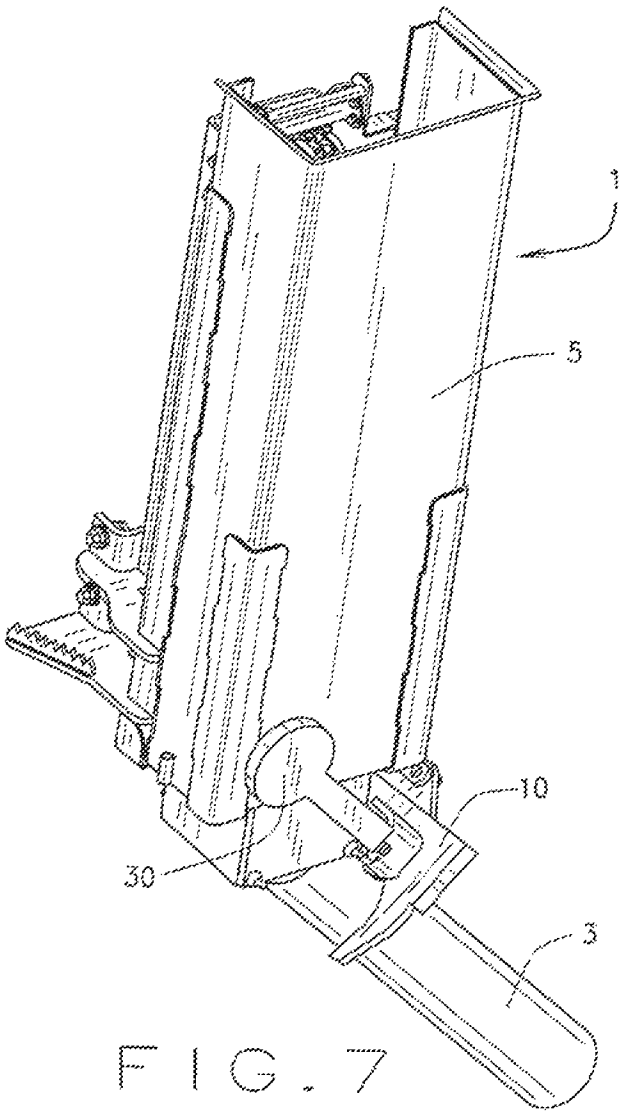
FIG. 7 is a perspective view of the post driver of FIG. 6, utilizing a counterweight biasing mechanism.
Figure 6:
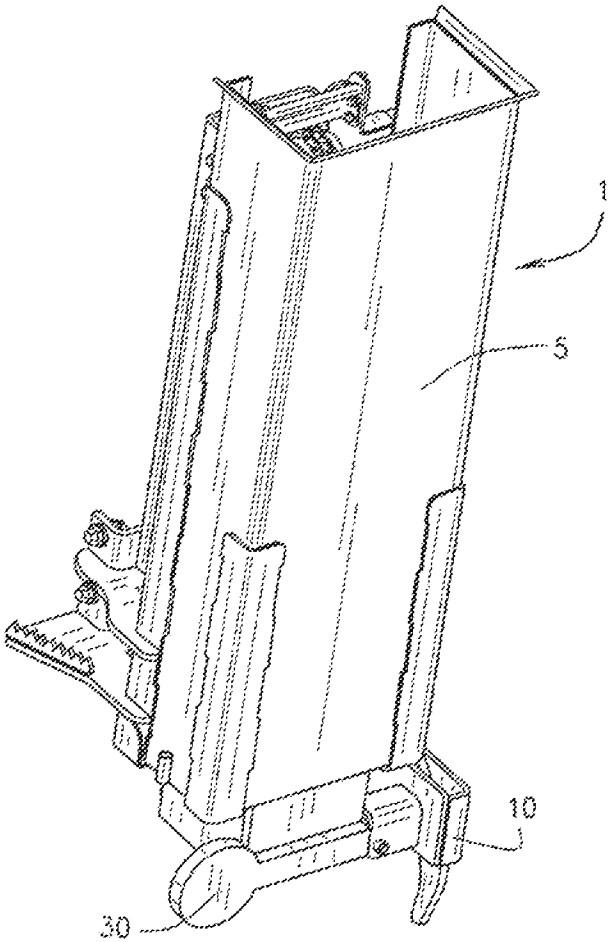
FIG. 6 is a perspective view of a post driver with a grapple mechanism utilizing a counterweight biasing mechanism.

FIGS. 6 and 7 illustrate another embodiment, in which the biasing mechanism is not a spring 22, but is instead a counterweight 30. The counterweight 30 is preferably positioned on the far side of pin 20 from the grapple mechanism 10, so as to counter-balance the weight of the grapple mechanism 10. As shown, in FIG. 6, the downward pull of gravity on the counterweight 30 overpowers the downward pull of gravity on the grapple mechanism 10, biasing the grapple mechanism 10 toward its generally horizontal position when a post 3 is not grappled. However, as shown in FIG. 7, once a post is grappled by the jaws 16, 18, the combined weight of the grapple mechanism 10 and post 3 is sufficient to overcome the counterweight 30, causing the grapple mechanism 10 to swing into its generally vertical position for driving the post 3. As above, this biasing mechanism is mechanical in nature, rather than hydraulic or electrically assisted.

In another embodiment, the biasing mechanism: which biases the grapple mechanism 10 toward a position generally parallel with the ground may not be an additional component at all. The biasing mechanism may instead be the size, shape, and weight distribution of the grapple mechanism 10 itself including jaws 16, 18. In such an embodiment, the weight distribution of the grapple mechanism 10 itself may be designed so as to cause the grapple mechanism 10 to reside in its generally horizontal position (parallel with the ground) when no post is grappled, but which swings into a substantially vertical position when a post is grappled and lifted.

As is evident from the foregoing description, certain aspects of the present disclosure are not limited by the particular details of the examples illustrated herein, and it is therefore contemplated that other modifications and applications, or equivalents thereof, will occur to those skilled in the art. It is accordingly intended that the claims shall cover all such modifications and applications that do not depart from the spirit and scope of the present disclosure. Moreover, unless defined otherwise, all technical and scientific terms used herein have the same meaning as commonly understood by one of ordinary skill in the art to which the disclosure belongs. Although any methods and materials similar to or equivalent to or those described herein can be used in the practice or testing of the present disclosure, the preferred methods and materials are described above. Other aspects, objects and advantages of the present disclosure can be obtained from a study of the drawings, the disclosure and the appended claims.

The invention claimed is:

1. A post driver comprising:

a main housing including a weight for impacting a post;

a grapple mechanism rotatably attached to the housing, the grapple mechanism including geared rotatable jaws, said rotatable attachment between said grapple mechanism and said housing permitting said grapple mechanism to rotate to a vertical position which is at least partially directly below the housing; and a biasing mechanism associated with the grapple mechanism, wherein the biasing mechanism allows for rotation of the grapple mechanism to the vertical position when the grapple mechanism is grappled with a post, but which mechanically prevents rotation of the grapple mechanism when the grapple mechanism is not grappled with a post.

2. The post driver of claim 1 wherein the grapple mechanism is attached to one side of the main housing.

3. The post driver of claim 1 wherein the grapple mechanism is attached to a flange of the main housing via a pin.

4. The post driver of claim 3 wherein the grapple mechanism rotates about the pin.

5. The post driver of claim 1 wherein the grapple mechanism is biased by the biasing mechanism toward a generally horizontal position.

6. The post driver of claim 1 wherein the grapple mechanism rotates to a generally vertical position when grappled with and supporting the weight of a said post.

7. The post driver of claim 1 wherein the grapple mechanism rotates generally under the main housing from a side of the main housing other than the front of the main housing.

8. The post driver of claim 1 wherein the geared rotatable jaws are hydraulically actuated.

9. The post driver of claim 1 wherein the geared rotatable jaws include two jaws spaced apart to receive an opposing jaw therebetween.

10. The post driver of claim 1 wherein the biasing mechanism is a spring with sufficient tension to maintain the grapple mechanism in a horizontal position when the grapple mechanism is grappled with a post, but without sufficient tension to maintain the grapple mechanism in its horizontal position when the grapple mechanism is grappled with and supporting the weight of a post.

11. The post driver of claim 10 wherein the spring is affixed between the main housing and the grapple mechanism.

12. The post driver of claim 1 wherein the biasing mechanism includes a counterweight.

13. The post driver of claim 12 wherein the counterweight is affixed to the grapple mechanism and is positioned on an opposite side of a rotation point from the grapple mechanism.

14. The post driver of claim 1 wherein the biasing mechanism includes the size, shape and weight distribution of the grapple mechanism which counterbalances the grapple mechanism.

15. A grapple mechanism rotatably attached to a post driver about a pivot point, the grapple mechanism comprising:

rotatable jaws;

gears for rotating the jaws;

a grapple housing supporting the jaws and gears; and a biasing mechanism structured to bias the grapple mechanism in a generally horizontal position when at rest, but having an insufficient bias to maintain the grapple mechanism in the generally horizontal position when the rotatable jaws grapple and lift a post, such that upon grappling and lifting a post, said grapple mechanism pivots to a vertical position which is at least partially directly below the post driver.

* * * * *